US010920548B2

(12) United States Patent
Lastra et al.

(10) Patent No.: US 10,920,548 B2
(45) Date of Patent: Feb. 16, 2021

(54) METHOD AND APPARATUS FOR RIG-LESS DEPLOYMENT OF ELECTRICAL SUBMERSIBLE PUMP SYSTEMS

(71) Applicant: Saudi Arabian Oil Company, Dhahran (SA)

(72) Inventors: Rafael Adolfo Lastra, Dhahran (SA); Mohannad Abdelaziz, Dhahran (SA); Jinjiang Xiao, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 16/137,116

(22) Filed: Sep. 20, 2018

(65) Prior Publication Data

US 2020/0095852 A1 Mar. 26, 2020

(51) Int. Cl.

| | |
|---|---|
| ***E21B 43/12*** | (2006.01) |
| ***E21B 23/00*** | (2006.01) |
| ***F04D 13/06*** | (2006.01) |
| ***F04B 47/06*** | (2006.01) |

(52) U.S. Cl.

CPC ..... *E21B 43/128* (2013.01); *E21B 23/00* (2013.01); *F04B 47/06* (2013.01); *F04D 13/06* (2013.01)

(58) Field of Classification Search

CPC ..... E21B 43/128; E21B 23/00; E21B 47/06; F04D 13/06; F04D 13/086; F04D 13/10

USPC ..... 29/605

See application file for complete search history.

(56) References Cited

U.S. PATENT DOCUMENTS

| | | | |
|---|---|---|---|
| 6,288,470 | B1 | 9/2001 | Breit |
| 6,599,091 | B2 | 7/2003 | Nagle |
| 6,700,252 | B2 | 3/2004 | Fleshman et al. |
| 6,794,788 | B1 | 9/2004 | Smith et al. |
| 6,863,124 | B2 | 3/2005 | Araux et al. |
| 6,926,504 | B2 | 8/2005 | Howard |

(Continued)

FOREIGN PATENT DOCUMENTS

| | | | |
|---|---|---|---|
| WO | 0031417 | A1 | 6/2000 |
| WO | 2017115094 | A1 | 7/2017 |
| WO | 2018022198 | A1 | 2/2018 |

OTHER PUBLICATIONS

International Search Report and Written Opinion for related PCT application PCT/US2019/051628 dated Dec. 18, 2019.

*Primary Examiner* — David J Bagnell
*Assistant Examiner* — Yanick A Akaragwe
(74) *Attorney, Agent, or Firm* — Bracewell LLP; Constance G. Rhebergen; Linda L. Morgan

(57) ABSTRACT

Systems and methods for producing hydrocarbons from a subterranean well include a first electrical submersible pump section having an outer motor body, and a motor stator. A central bore extends through the motor body and is sized to accommodate a motor rotor assembly. A second electrical submersible pump section has the motor rotor assembly, a seal section, and a pump section. The first electrical submersible pump section has a downhole ring shaped to secure the first electrical submersible pump section to a downhole production tubing, and has an uphole ring shaped to secure the first electrical submersible pump section to an uphole production tubing. The second electrical submersible pump section has a deployment connector operable to connect to an installation line for rig-less installation and removal of the second electrical submersible pump section.

12 Claims, 3 Drawing Sheets

(56) References Cited

U.S. PATENT DOCUMENTS

| | | | | |
|---|---|---|---|---|
| 9,140,101 | B2 * | 9/2015 | Scott | E21B 43/128 |
| 10,370,947 | B1 * | 8/2019 | Artinian | E21B 17/02 |
| 2011/0189036 | A1 | 8/2011 | Long | |
| 2013/0062050 | A1 | 3/2013 | Head | |
| 2013/0259721 | A1 * | 10/2013 | Noui-Mehidi | F04B 17/03 417/410.1 |
| 2014/0174756 | A1 | 6/2014 | Sakamoto | |
| 2016/0040675 | A1 | 2/2016 | Semple et al. | |
| 2016/0168964 | A1 | 6/2016 | Li et al. | |
| 2017/0254172 | A1 | 9/2017 | Mack et al. | |
| 2017/0362953 | A1 | 12/2017 | Gatzen et al. | |
| 2018/0051543 | A1 | 2/2018 | Al-Zahrani | |
| 2018/0066479 | A1 * | 3/2018 | Head | E21B 33/0407 |

* cited by examiner

METHOD AND APPARATUS FOR RIG-LESS DEPLOYMENT OF ELECTRICAL SUBMERSIBLE PUMP SYSTEMS

BACKGROUND OF THE DISCLOSURE

1. Field of the Disclosure

The disclosure relates generally to electrical submersible pumps and in particular, to electrical submersible pump assemblies with separable motors.

2. Description of the Related Art

One method of producing hydrocarbon fluid from a well bore that lacks sufficient internal pressure for natural production is to utilize an artificial lift method such as an electrical submersible pump. The submersible pumping device is suspended near the bottom of the well bore proximate to the producing formation. The submersible pumping device is operable to retrieve production zone fluid, to impart a higher pressure into the fluid, and to discharge the pressurized production zone fluid into production tubing. Pressurized well bore fluid rises towards the surface motivated by the difference in pressure. Electrical submersible pumps can be useful, for example, in high gas to oil ratio operations and in aged fields where there is a loss of energy and the hydrocarbons can no longer reach the surface naturally.

Current electrical submersible pumps are manufactured and assembled in three major parts which are a motor, a seal section and a pump. A current common deployment method is to install, pull, and replace the electrical submersible pump with a drilling or workover rig.

SUMMARY OF THE DISCLOSURE

Embodiments disclosed herein provide an electrical submersible pump assembly that allows for installation, removal, and replacement of a pump section without the use of a drilling or workover rig. Systems and methods of this disclosure provide an electrical submersible pump system that can be separated into a two separate sections. The first section is a semi-permanent installation and includes the motor stator assembly. The second section of the electrical submersible pump system is removable without the use of a drilling or workover rig and includes the motor rotor assembly.

In an embodiment of this disclosure, a system for producing hydrocarbons from a subterranean well includes a first electrical submersible pump section having an outer motor body, a motor stator, and a central bore. The central bore extends through the outer motor body and is sized to accommodate a motor rotor assembly. A second electrical submersible pump section has the motor rotor assembly, a seal section, and a pump section. The first electrical submersible pump section has a downhole ring shaped to secure the first electrical submersible pump section to a downhole production tubing. The first electrical submersible pump section also has an uphole ring shaped to secure the first electrical submersible pump section to an uphole production tubing. The second electrical submersible pump section has a deployment connector operable to connect to an installation line for rig-less installation and removal of the second electrical submersible pump section.

In alternate embodiments, the system can further include a plug located within the central bore of the first electrical submersible pump section. The plug can be removable. When the plug is removed from the central bore the central bore can provide a passage through the first electrical submersible pump section from an uphole end of the first electrical submersible pump section to a downhole end of the first electrical submersible pump section.

In other alternate embodiments, the first electrical submersible pump section can include an uphole facing landing shoulder. The uphole facing landing shoulder can be sized to engage and support a downhole facing mating shoulder of the second electrical submersible pump section. The second electrical submersible pump section can have an anchor. The anchor can be operable to engage the uphole production tubing, preventing relative movement between the second electrical submersible pump section and the uphole production tubing and also provides isolation between the input ports and the discharge of the pump. A power cable can be secured to the first electrical submersible pump section. The power cable can be operable to provide electric power to the motor stator. The second electrical submersible pump section can have an outer diameter sized to pass through the uphole production tubing.

In an alternate embodiment of this disclosure, a system for producing hydrocarbons from a subterranean well includes a first electrical submersible pump section. The first electrical submersible pump section has an outer motor body, a motor stator, and a central bore. The central bore extends through the outer motor body. A second electrical submersible pump section has a motor rotor assembly, a seal section, and a pump section. The first electrical submersible pump section has a downhole ring secured to a downhole production tubing. The first electrical submersible pump section also has an uphole ring shaped secured to an uphole production tubing so that the first electrical submersible pump section is secured in-line with a production tubing. The motor rotor assembly is located within the central bore of the first electrical submersible pump section. The second electrical submersible pump section has a deployment connector operable to connect to an installation line for rig-less installation and removal of the second electrical submersible pump section through the production tubing.

In alternate embodiments, the first electrical submersible pump section can include an uphole facing landing shoulder. The uphole facing landing shoulder can engage and support a downhole facing mating shoulder of the second electrical submersible pump section. The second electrical submersible pump section can have an anchor. The anchor can engage the uphole production tubing, preventing relative movement between the second electrical submersible pump section and the uphole production tubing and also provides isolation between the input ports and the discharge of the pump. A power cable can be secured to the first electrical submersible pump section. The power cable can extend radially outward of the production tubing and provide electric power to the motor stator.

In another alternate embodiment of the disclosure, a method for producing hydrocarbons from a subterranean well includes providing a first electrical submersible pump section. The first electrical submersible pump section has an outer motor body, a motor stator, and a central bore. The central bore extends through the outer motor body and is sized to accommodate a motor rotor assembly. The first electrical submersible pump section is secured to a downhole production tubing with a downhole ring of the first electrical submersible pump section. The first electrical submersible pump section is secured to an uphole production tubing with an uphole ring of the first electrical submersible pump section. A second electrical submersible pump section has the motor rotor assembly, a seal section, and a pump section. An installation line is connected to a deployment connector of the second electrical submersible pump section for rig-less installation and removal of the second electrical submersible pump section.

In alternate embodiments, the method can further include removing a plug from the central bore so that the central bore provides a passage through the first electrical submersible pump section from an uphole end of the first electrical submersible pump section to a downhole end of the first electrical submersible pump section. A downhole facing mating shoulder of the second electrical submersible pump section can engage and be supported by an uphole facing landing shoulder of the first electrical submersible pump section.

In other alternate embodiments, the method can include engaging the uphole production tubing with an anchor of the second electrical submersible pump section, preventing relative movement between the second electrical submersible pump section and the uphole production tubing and isolating between the intake and discharge of the pump. An electric power can be provided to the motor stator with a power cable secured to the first electrical submersible pump section. The second electrical submersible pump section can have an outer diameter sized to pass through the uphole production tubing.

BRIEF DESCRIPTION OF THE DRAWINGS

So that the manner in which the recited features, aspects and advantages of the embodiments of this disclosure, as well as others that will become apparent, are attained and can be understood in detail, a more particular description of the disclosure may be had by reference to the embodiments that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended Claims to a method comprising two or more defined steps, the defined steps can be carried out in any order or simultaneously except where the context excludes that possibility.

Figure 1:
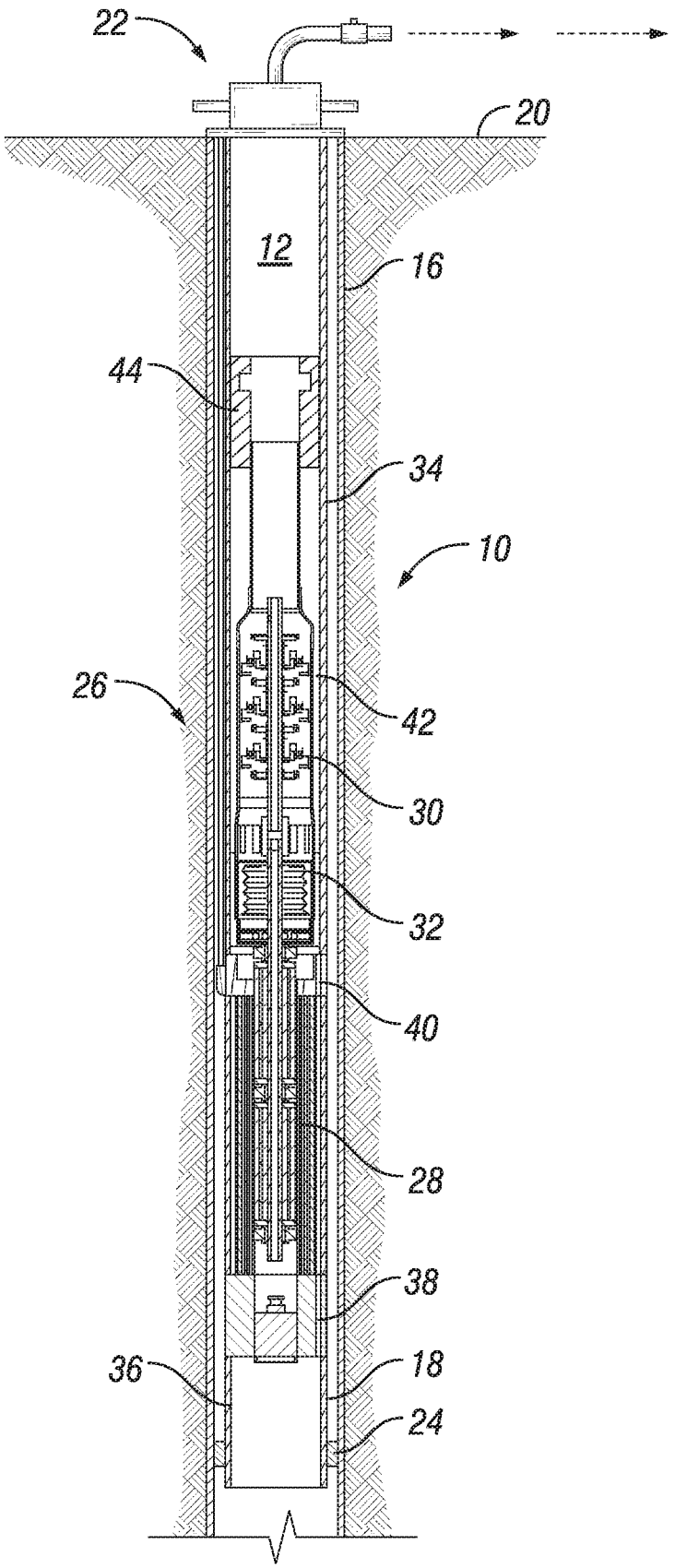
FIG. 1 is a section view of a subterranean well having an electrical submersible pump assembly, in accordance with an embodiment of this disclosure.

Looking at FIG. 1, subterranean well 10 includes wellbore 12. Wellbore 12 of subterranean well 10 can be lined with casing 16. Production tubing 18 can be located within wellbore 12 for delivering hydrocarbons and other wellbore fluids to surface 20. The hydrocarbons and other wellbore fluids can be produced through wellhead assembly 22 that is located at surface 20 and in fluid communication with production tubing 18. Packer 24 can circumscribe production tubing 18 proximate to a downhole end of production tubing 18. Packer 24 can seal the annular space between an outer diameter surface of production tubing 18 and an inner diameter surface of casing 16.

Electrical submersible pump assembly 26 is located within wellbore 12. Electrical submersible pump assembly 26 of FIG. 1 includes motor assembly 28 that is used to drive pump 30 of electrical submersible pump assembly 26. Between motor assembly 28 and pump 30 is seal section 32 for equalizing pressure within electrical submersible pump assembly 26 with that of wellbore 12.

Motor assembly 28 can be positioned in line with production tubing 18 so that uphole production tubing 34 is located uphole of motor assembly 28. Downhole production tubing 36 is located downhole of motor assembly 28. Downhole production tubing 36 can be a separate portion of production tubing 18 than uphole production tubing 34. Downhole production tubing 36 can be spaced apart from uphole production tubing 34. In the example embodiment of FIG. 1, an outer diameter of production tubing 18 aligns with an outer diameter of motor assembly 28.

Downhole port 38 can extend through a downhole end of motor assembly 28 to provide a fluid flow path for production fluids to travel from downhole of packer 24 and through motor assembly 28. Uphole port 40 can extend through an uphole end of motor assembly 28. Uphole port 40 can provide a fluid flow path for production fluids to travel from motor assembly 28 and into annular space 42 between an outer diameter of electrical submersible pump assembly 26 and an inner diameter of uphole production tubing 34.

Pump 30 can be mechanically connected to anchor 44. Anchor 44 can engage uphole production tubing 34 and prevent relative movement between pump 30 and uphole production tubing 34. Anchor 44 can additionally provide isolation between the intake and discharge of the pump.

Figure 2:
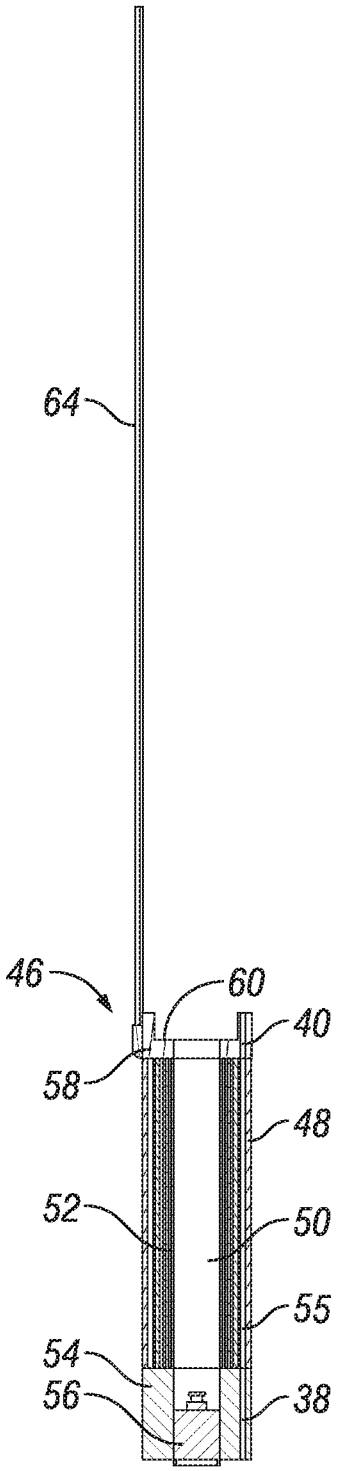
FIG. 2 is a section view of a first electrical submersible pump section, in accordance with an embodiment of this disclosure.

Electrical submersible pump assembly 26 can be made up of two main sections. Looking at FIG. 2, one of the sections that makes up electrical submersible pump assembly 26 is first electrical submersible pump section 46. First electrical submersible pump section 46 includes outer motor body 48. Outer motor body 48 can have an elongated generally tubular shape. Outer motor body 48 has central bore 50. Central bore 50 extends through outer motor body 48. Outer motor body 48 houses motor stator 52. Motor stator 52 can be, as an example, a laminated steel core with wound copper wires spaced around a circumference of the laminated steel core.

First electrical submersible pump section 46 has downhole ring 54. Downhole ring 54 is shaped to secure first electrical submersible pump section 46 to downhole production tubing 36 (FIG. 1). Downhole ring 54 contains a portion of central bore 50. Downhole port 38 extends through downhole ring 54. Downhole port 38 extends from the downhole end of first electrical submersible pump section 46 to annular space 55. Annular space 55 is defined by an outer diameter of motor stator 52 and an inner diameter of an outer shell of outer motor body 48.

Plug 56 can be located within central bore 50. When plug 56 is located within central bore 50 of downhole ring 54, plug 56 seals an inner diameter of central bore 50, preventing fluids from passing through central bore 50 of downhole ring 54. When plug 56 is removed from central bore 50 of downhole ring 54, central bore 50 is free of obstruction and fluids can pass through downhole ring 54. When plug 56 is removed from central bore 50, central bore provides a passage through first electrical submersible pump section 46 from an uphole end of first electrical submersible pump section 46 to downhole end of the first electrical submersible pump section 46. When plug 56 is removed from central bore 50 tools and instruments can pass through central bore 50 for performing operations within wellbore 12 downhole of first electrical submersible pump section 46.

First electrical submersible pump section 46 has uphole ring 58. Uphole ring 58 is shaped to secure first electrical submersible pump section 46 to uphole production tubing 34 (FIG. 1). Uphole ring 58 contains a portion of central bore 50. Uphole port 40 extends through uphole ring 58. Uphole port 40 extends from annular space 55 to the uphole end of first electrical submersible pump section 46. Downhole port 38 together with uphole port 40 allow for production fluids to travel from downhole of first electrical submersible pump section 46, past motor stator 52 and to a location uphole of first electrical submersible pump section 46.

First electrical submersible pump section 46 further includes uphole facing landing shoulder 60. Uphole facing landing shoulder 60 is sized to engage and support second electrical submersible pump section 62 (FIG. 3).

Power cable 64 is secured to first electrical submersible pump section 46. Power cable 64 is operable to provide electric power to motor stator 52. Power cable 64 can have a sealed termination at uphole ring 58 of first electrical submersible pump section 46. Power cable 64 can be a suitable power cable for powering and providing control signals to an electrical submersible pump assembly 26, known to those with skill in the art.

Figure 3:
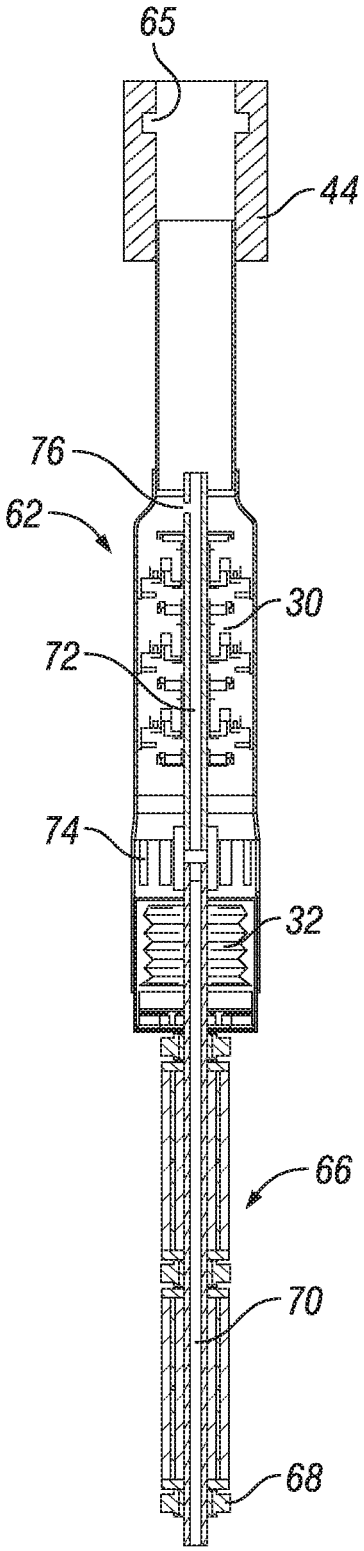
FIG. 3 is a section view of a second electrical submersible pump section, in accordance with an embodiment of this disclosure.

Looking at FIG. 3 the second of the sections that makes up electrical submersible pump assembly 26 (FIG. 1) is second electrical submersible pump section 62. Second electrical submersible pump section 62 includes deployment connector 65 that is operable to connect to an installation line for rig-less installation and removal of second electrical submersible pump section 62. Deployment connector 65 can be for example, threads, a shoulder, a groove, or other shaped surface for engaging the installation line.

Second electrical submersible pump section 62 includes motor rotor assembly 66. Motor rotor assembly 66 can be made up of an iron core of rotor laminations and axially oriented copper bars spaced around a circumference of the iron core. In alternate embodiments permanent magnets can be used instead or in combination with copper bars. Motor rotor assembly 66 further includes a series of rotor bearings 68. Rotor shaft 70 extends axially through a center of the iron core.

Second electrical submersible pump section 62 further includes seal section 32 and pump 30. Rotor shaft 70 can extend into seal section 32. Rotor shaft 70 mates with pump shaft 72 so that as rotor shaft 70 rotates, pump shaft 72 is rotated. In the example embodiments shown, pump 30 is a centrifugal pump with a series of pump stages. In alternate embodiment, other types of know pumps suitable for use with electrical submersible pumps can be used.

Fluid input ports 74 allow production fluids to enter pump 30 and fluid pump discharge 76 allow production fluids to exit pump 30 after such production fluids have passed through pump 30. Second electrical submersible pump section 62 also includes anchor 44. Deployment connector 65 can be part of anchor 44.

Figure 4:
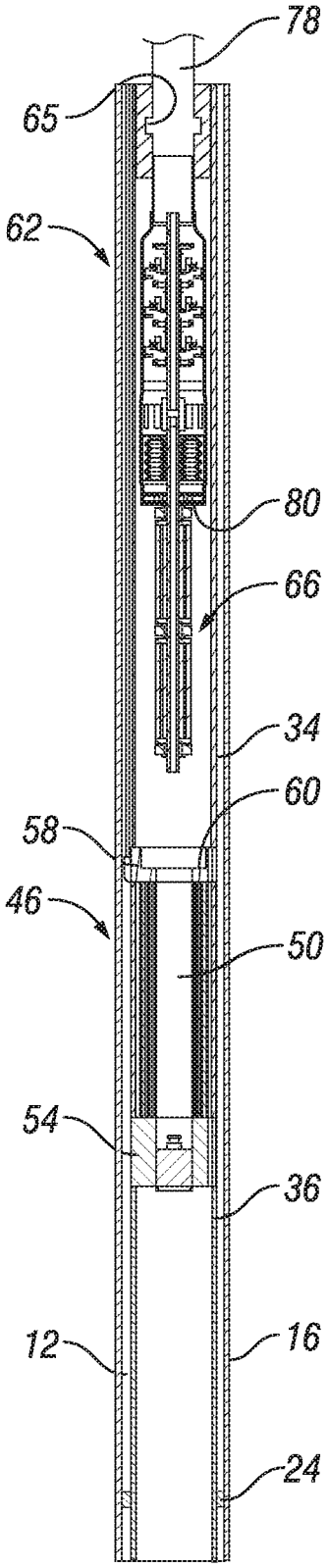
FIG. 4 is a section view of the first electrical submersible pump section being lowered into the second electrical submersible pump section, in accordance with an embodiment of this disclosure.

Looking at FIG. 4, in an example of operation, first electrical submersible pump section 46 can be made up with downhole production tubing 36 and uphole production tubing 34. Downhole ring 54 of first electrical submersible pump section 46 can be threaded to or otherwise secured to downhole production tubing 36. Uphole ring 58 of first electrical submersible pump section 46 can be threaded to or otherwise secured to uphole production tubing 34. In this way, first electrical submersible pump section 46 can be secured in-line with production tubing 18.

First electrical submersible pump section 46 can then be lowered into wellbore 12 in the usual manner known in the art. Production tubing 18 can be secured within wellbore 12 and packer 24 can be set between production tubing 18 and casing 16. In this manner, first electrical submersible pump section 46 becomes part of the completion that remains within wellbore 12 during hydrocarbon production operations.

After first electrical submersible pump section 46 is set in wellbore 12, second electrical submersible pump section 62 can be lowered into uphole production tubing 34. Second electrical submersible pump section 62 has an outer diameter sized to pass through uphole production tubing 34. Second electrical submersible pump section 62 can be lowered through uphole production tubing 34 with installation line 78 that is connected to deployment connector 65 of second electrical submersible pump section 62. Installation line 78 can be used to lower second electrical submersible pump section 62 through uphole production tubing 34 without the use of a drilling or workover rig. Installation line 78 can be, for example, coiled tubing, wire line, or a slick line.

Central bore 50 is sized to accommodate motor rotor assembly 66. Second electrical submersible pump section 62 can be centralized so that motor rotor assembly 66 is aligned with central bore 50. Second electrical submersible pump section 62 can be lowered through uphole production tubing 34 until motor rotor assembly 66 is fully inserted into central bore 50. Uphole facing landing shoulder 60 of first electrical submersible pump section 46 is sized to engage and support downhole facing mating shoulder 80 of second electrical submersible pump section 62 when motor rotor assembly 66 is fully inserted into central bore 50.

Figure 5:
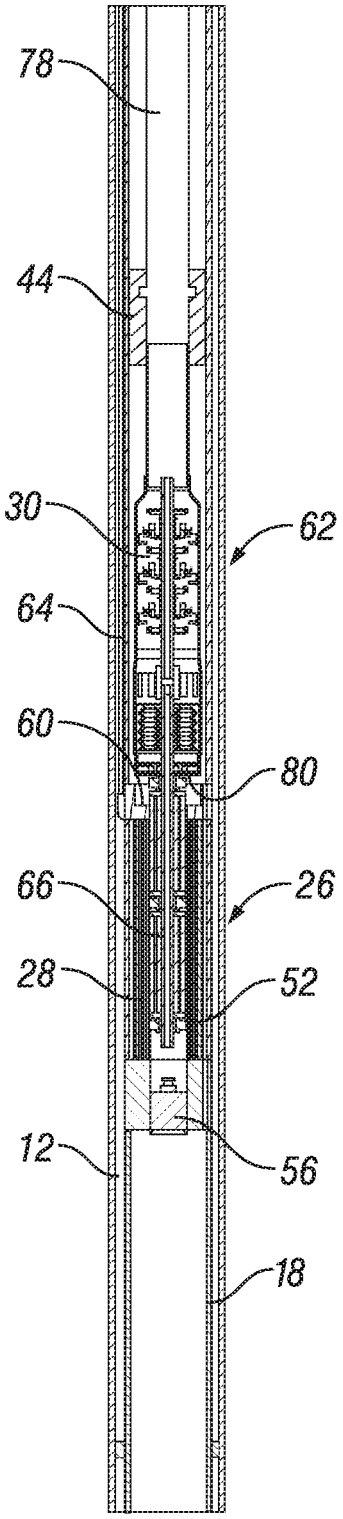
FIG. 5 is a section view of the first electrical submersible pump section landed in the second electrical submersible pump section, in accordance with an embodiment of this disclosure.

Looking at FIG. 5, downhole facing mating shoulder 80 of second electrical submersible pump section 62 is landed on uphole facing landing shoulder 60 of first electrical submersible pump section 46. Anchor 44 can be actuated so that anchor 44 can engage uphole production tubing 34 and prevent relative movement between pump 30 and uphole production tubing 34 and also provides isolation between the input ports 74 and discharge 76 of second electrical submersible pump section 62. Power cable 64 extends through wellbore 12 radially outward of production tubing 18. Power cable 64 has a sealed termination at uphole ring 58 of first electrical submersible pump section 46 so that no wet connectors are required at the termination of power cable 64. Motor rotor assembly 66 and motor stator 52 interact magnetically or electromagnetically so that no wet connectors are required within motor assembly 28. Without exposed cable or motor connectors, the run life of the electrical system is extended beyond electrical systems that have a wet connector or other exposed electrical connections.

In certain embodiments, motor rotor assembly 66 and motor stator 52 are open to fluids from within wellbore 12 so that no motor protector or separate motor lubricating or cooling oil is required.

Electrical submersible pump assembly 26 can be energized and operated to lift wellbore fluids in a manner known in the art. If pump 30 requires repair or replacement, or if operations are to be performed downhole of electrical submersible pump assembly 26, installation line 78 can be reattached to second electrical submersible pump section 62 and second electrical submersible pump section 62 can be pulled from wellbore 12. If required, plug 56 can also be removed and operations, such as logging, can be performed through central bore 50. Second electrical submersible pump section 62 can be deployed, retrieved and replaced several times using rig-less operations.

Therefore, as disclosed herein, embodiments of the systems and methods of this disclosure provide an electrical submersible pump assembly that allows for installation, removal, and replacement of a pump section without the use of a drilling or workover rig. Systems and methods of this disclosure provide an electrical submersible pump system that can be separated into a two separate sections. The first section is a semi-permanent installation and includes the motor stator assembly. The second section of the electrical submersible pump system is removable without the use of a drilling or workover rig and includes the motor rotor assembly.

Embodiments of the disclosure described herein, therefore, are well adapted to carry out the objects and attain the ends and advantages mentioned, as well as others inherent therein. While embodiments of the disclosure has been given for purposes of disclosure, numerous changes exist in the details of procedures for accomplishing the desired results. These and other similar modifications will readily suggest themselves to those skilled in the art, and are intended to be encompassed within the present disclosure and the scope of the appended claims.

What is claimed is:

1. A system for producing hydrocarbons from a subterranean well, the system including:

a first electrical submersible pump section having an outer motor body, a motor stator, and a central bore, the central bore extending through the outer motor body and sized to accommodate a motor rotor assembly where the first electrical submersible pump section includes an uphole facing landing shoulder;

a second electrical submersible pump section having the motor rotor assembly, a seal section, a pump assembly, and a downhole facing mating shoulder, the second electrical pump section being separable from the first electrical submersible pump section; where the first electrical submersible pump section has a downhole ring shaped to secure the first electrical submersible pump section to a downhole production tubing, and has an uphole ring shaped to secure the first electrical submersible pump section to an uphole production tubing;

the second electrical submersible pump section has a deployment connector operable to connect to an installation line for rig-less installation and removal of the second electrical submersible pump section with the second electrical pump section separated from the first electrical submersible pump section; and the uphole facing landing shoulder is sized to support the downward facing mating shoulder and allow for axial movement of the second electrical submersible pump section relative to the first electrical submersible pump section, where the second electrical submersible pump section has an anchor, where the anchor is operable to engage the uphole production tubing, preventing relative pump assembly.

2. The system of claim 1, further including a plug located within the central bore of the first electrical submersible pump section, where the plug is removable, and where when the plug is removed from the central bore then the central bore provides a passage through the first electrical submersible pump section from an uphole end of the first electrical submersible pump section to a downhole end of the first electrical submersible pump section.

3. The system of claim 1, further including a power cable secured to the first electrical submersible pump section, the power cable operable to provide electric power to the motor stator.

4. The system of claim 1, where the second electrical submersible pump section has an outer diameter sized to pass through the uphole production tubing.

5. A system for producing hydrocarbons from a subterranean well, the system including:

a first electrical submersible pump section having an outer motor body, a motor stator, and a central bore, the central bore extending through the outer motor body;

a second electrical submersible pump section having a motor rotor assembly, a seal section, and a pump assembly, the second electrical pump section being separable from the first electrical submersible pump section; where the first electrical submersible pump section has a downhole ring secured to a downhole production tubing, and has an uphole ring shaped secured to an uphole production tubing so that the first electrical submersible pump section is secured in-line with a production tubing;

the motor rotor assembly is located within the central bore of the first electrical submersible pump section;

the second electrical submersible pump section has a deployment connector operable to connect to an installation line for rig-less installation and removal of the second electrical submersible pump section through the production tubing with the second electrical pump section separated from the first electrical submersible pump section; and the second electrical submersible pump section has an anchor, where the anchor engages the uphole production tubing, preventing relative movement between the second electrical submersible pump section and the uphole production tubing and also provides isolation between input ports and a discharge of the pump assembly.

6. The system of claim 5, where the first electrical submersible pump section includes an uphole facing landing shoulder, the uphole facing landing shoulder engaging and supporting a downhole facing mating shoulder of the second electrical submersible pump section.

7. The system of claim 5, further including a power cable secured to the first electrical submersible pump section, the power cable extending radially outward of the production tubing and providing electric power to the motor stator.

8. A method for producing hydrocarbons from a subterranean well, the method including:

providing a first electrical submersible pump section having an outer motor body, a motor stator, and a central bore, the central bore extending through the outer motor body and sized to accommodate a motor rotor assembly, where the first electrical submersible pump section includes an uphole facing landing shoulder;

securing the first electrical submersible pump section to a downhole production tubing with a downhole ring of the first electrical submersible pump section;

securing the first electrical submersible pump section to an uphole production tubing with an uphole ring of the first electrical submersible pump section;

providing a second electrical submersible pump section having the motor rotor assembly, a seal section, a pump assembly, and a downhole facing mating shoulder, the second electrical pump section being separable from the first electrical submersible pump section;

connecting an installation line to a deployment connector of the second electrical submersible pump section for rig-less installation and removal of the second electrical submersible pump section with the second electrical submersible pump section separated from the first electrical submersible pump section; and supporting the downward facing mating shoulder with the uphole facing landing shoulder, the uphole facing landing shoulder shaped to allow for relative axial movement of the second electrical submersible pump section relative to the first electrical submersible pump section, engaging the uphole production tubing with an anchor of the second electrical submersible pump section, preventing relative movement between the second electrical submersible pump section and the uphole production lubing and isolating between input ports and discharge of the pump assembly.

9. The method of claim 8, further including removing a plug from the central bore so that the central bore provides a passage through the first electrical submersible pump section from an uphole end of the first electrical submersible pump section to a downhole end of the first electrical submersible pump section.

10. The method of claim 8, further including providing an electric power to the motor stator with a power cable secured to the first electrical submersible pump section.

11. The method of claim 8, where the second electrical submersible pump section has an outer diameter sized to pass through the uphole production tubing.

12. A method for producing hydrocarbons from a subterranean well, the method including:

providing a first electrical submersible pump section having an outer motor body, a motor stator, and a central bore, the central bore extending through the outer motor body and sized to accommodate a motor rotor assembly;

securing the first electrical submersible pump section to a downhole production tubing with a downhole ring of the first electrical submersible pump section;

securing the first electrical submersible pump section to an uphole production tubing with an uphole ring of the first electrical submersible pump section;

providing a second electrical submersible pump section having the motor rotor assembly, a seal section, and a pump assembly, the second electrical pump section being separable from the first electrical submersible pump section, where the second electrical submersible pump section has an anchor, where the anchor engages the uphole production tubing, preventing relative movement between the second electrical submersible pump section and the uphole production tubing and also provides isolation between input ports and a discharge of the pump assembly;

connecting an installation line to a deployment connector of the second electrical submersible pump section for rig-less installation and removal of the second electrical submersible pump section with the second electrical submersible pump section separated from the first electrical submersible pump section.

* * * * *